US006904357B2

(12) United States Patent
Hartmann et al.

(10) Patent No.: US 6,904,357 B2
(45) Date of Patent: Jun. 7, 2005

(54) METHOD AND ARRANGEMENT FOR CONTROLLING THE OUTPUT THE QUANTITY OF A DRIVE UNIT OF A VEHICLE

(75) Inventors: Dirk Hartmann, Stuttgart (DE); Holger Jessen, Ludwigsburg (DE); Mathieu Courtes, Paris (FR)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/615,465

(22) Filed: Jul. 9, 2003

(65) Prior Publication Data

US 2004/0073354 A1 Apr. 15, 2004

(30) Foreign Application Priority Data

Jul. 9, 2002 (DE) ..... 102 30 828

(51) Int. Cl.[7] ..... G06G 7/70

(52) U.S. Cl. ..... 701/110; 701/93; 701/97; 701/98; 701/99; 701/114; 123/350; 123/396; 123/399

(58) Field of Search ..... 701/93–110, 114; 123/350, 339.15, 339.21, 399, 359, 396

(56) References Cited

U.S. PATENT DOCUMENTS 6,125,322 A * 9/2000 Bischof et al. ..... 701/114
6,285,946 B1 * 9/2001 Steinmann ..... 701/110
6,487,489 B2 * 11/2002 Schmitt et al. ..... 701/93

* cited by examiner

*Primary Examiner*—Tony M. Argenbright
*Assistant Examiner*—Johnny H. Hoang
(74) *Attorney, Agent, or Firm*—Walter Ottesen

(57) ABSTRACT

A method and an arrangement control the output quantity (NMOTACT) of a drive unit (1) of a vehicle. The method and arrangement make possible a time-optimal control strategy especially during a shift operation of the vehicle. The output quantity (NMOTACT) is adjusted with the aid of an adjusting quantity (MDES) and tracks an input value (NMOTDES). In at least one pregiven operating state of the vehicle, the actuating quantity (NMOTDES) is brought to a pregiven limit value (MO, MU) when a pregiven control deviation (dnv) of the output quantity (NMOTACT) is exceeded.

11 Claims, 3 Drawing Sheets

METHOD AND ARRANGEMENT FOR CONTROLLING THE OUTPUT THE QUANTITY OF A DRIVE UNIT OF A VEHICLE

BACKGROUND OF THE INVENTION

Known methods for controlling the shift operation in automated manually-shifted transmissions of a vehicle utilize torque desired values or rpm desired values which, as operating state inputs for the engine, take the place of the driver command or other interventions in the drive power of the vehicle. The control takes place in different phases wherein suitable time-dependent traces of the engine output torque or the engine rpm are pregiven via the desired values by a transmission control apparatus. Known methods having the input of an rpm desired value utilize a PD control strategy or a PID control strategy for controlling out the deviation between the rpm desired value and the rpm actual value. The actuating quantity of the PD-controller or PID-controller is the engine output torque. It is known that the operating quantity of the PD-controller is formed as the sum of a component proportional to the rpm deviation and a component proportional to the rate of change of speed of the rpm so that especially for small rpm deviations as well as for negative rates of change of speed of the rpm deviations, the actuating quantity assumes low value. A limiting of the actuating quantity, which is usually present, is not optimally used.

SUMMARY OF THE INVENTION

The method of the invention and the arrangement of the invention for controlling the output quantity of a drive unit of a vehicle have the advantage that the actuating quantity is brought to a pregiven limit value in at least one pregiven operating state of the vehicle when a pregiven control deviation of the output quantity is exceeded. In this way, the control deviation of the output quantity can be very rapidly reduced in the at least one pregiven operating state so that a time-optimal control strategy is realized.

The method of the invention is for controlling the output quantity (NMOTACT) of a drive unit of a motor vehicle. The method includes the steps of: adjusting the output quantity (NMOTACT) utilizing a controller output (MDES) and causing the output quantity (NMOTACT) to track an input value (NMOTDES); and, bringing the controller output (MDES) to a pregiven limit value (MO, MU) in at least one pregiven operating state of the vehicle when a pregiven control deviation (dnv) of the output quantity (NMOTACT) is exceeded.

The arrangement of the invention is for controlling the output quantity (NMOTACT) of a drive unit of a motor vehicle and includes: means for adjusting the output quantity (NMOTACT) utilizing a controller output (MDES) and causing the output quantity (NMOTACT) to track an input value (NMOTDES); and, means for bringing the controller output (MDES) to a pregiven limit value (MO, MU) in at least one pregiven operating state of the vehicle when a pregiven control deviation (dnv) of the output quantity (NMOTACT) is exceeded.

It is especially advantageous when a shift operation of an automatic transmission or an automated manually-shifted transmission is provided as a pregiven operating state. In this way, the shift operation can be shortened or accelerated and thereby the time-dependent course of the shift operation can be improved.

An especially simple realization of the time-optimal control strategy results when the output quantity is controlled by a PD-controller or a PID-controller which generates the actuating quantity therefor, when the actuating quantity is limited in a limiter to a pregiven actuating region and when the pregiven actuating region is brought to zero in the at least one operating state.

It is furthermore advantageous when the pregiven actuating region is again expanded as soon as the pregiven control deviation is reached or there is a drop therebelow. In this way, the advantages of the PD-control or PID-control can be utilized for a sufficiently small control deviation.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
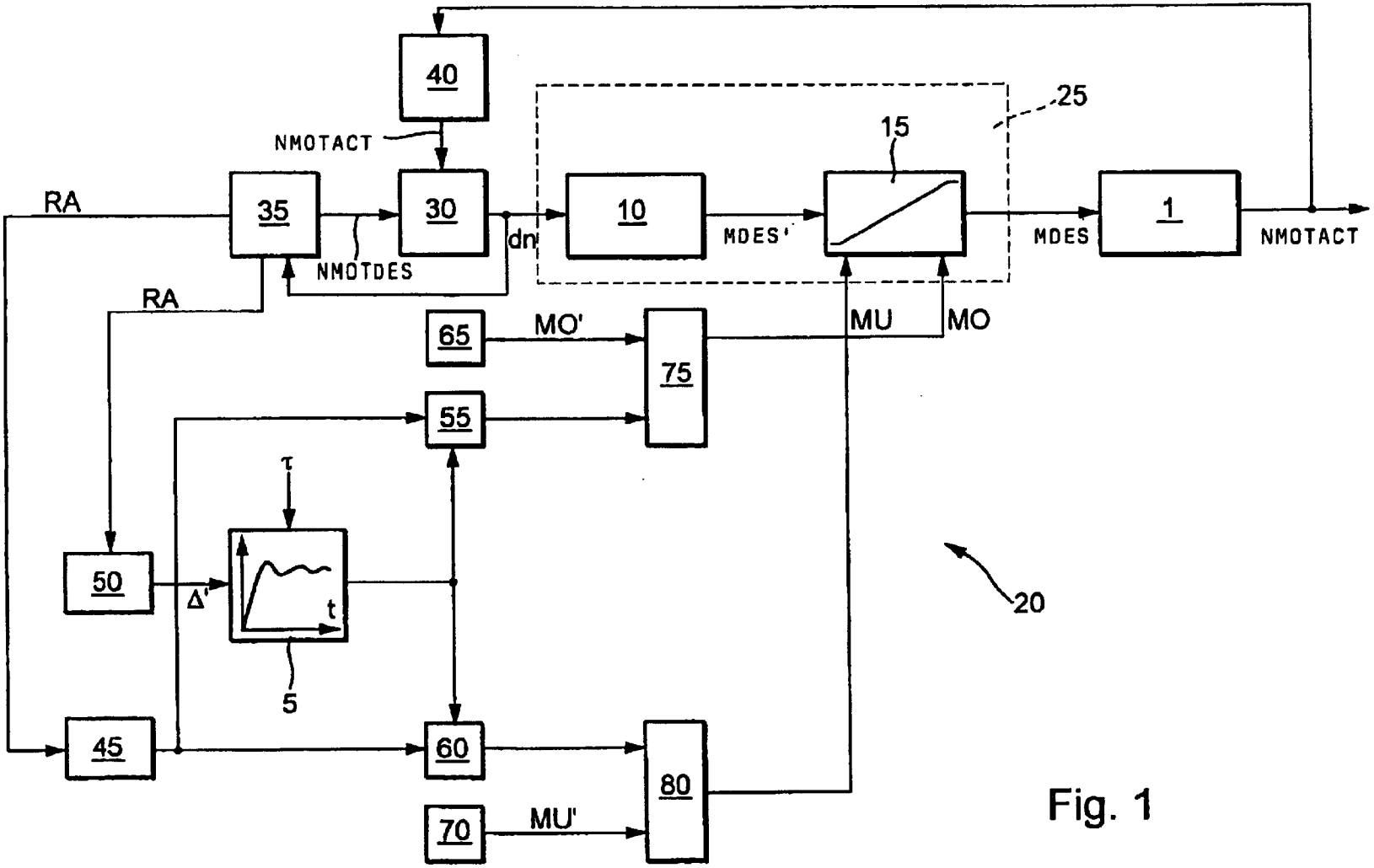
FIG. 1 is a block circuit diagram of an arrangement of the invention which, at the same time, makes clear the sequence of the method of the invention.

In FIG. 1, reference numeral 1 identifies a drive unit of a vehicle and this drive unit outputs an output quantity. In the following, it will be assumed by way of example that the output quantity of the drive unit 1 of the vehicle is an actual value NMOTACT of the engine rpm. In FIG. 1, reference numeral 20 identifies an arrangement for controlling the output quantity NMOTACT of the drive unit 1 of the vehicle. The arrangement 20 includes means 25 for forming a controller output or actuating variable or quantity which, in the following, is formed as the desired value MDES for the engine output torque by way of example. The controller output MDES is supplied to an engine control (not shown in FIG. 1) of the drive unit 1. The engine control realizes the desired value MDES of the engine output torque via a suitable setting of the throttle flap for the air supply, of the ignition angle and/or of the injection quantity in the case of a spark-ignition engine to form the output quantity NMOTACT. Furthermore, the arrangement 20 includes a measuring device 40 for measuring the output quantity of the drive unit 1, that is, the actual value NMOTACT of the engine rpm in the embodiment described here. The actual value NMOTACT of the engine rpm is determined by the measuring device 40 and is subtracted from an input value NMOTDES for the output quantity of the drive unit 1 in a first coupling point 30. In this embodiment, the output quantity is the engine rpm. A control deviation dn forms which is supplied to the means 25. The input value NMOTDES for the output quantity can be outputted by a transmission control 35 to the first coupling point 30 in the operating state of the vehicle viewed in accordance to FIG. 1. This operating state can be a shift operation of an automatic transmission or of an automated manually-shifted transmission of the vehicle which, in the following, is characterized as "transmission" and, for the sake of clarity, is not shown in FIG. 1. The invention can, however, be utilized in each desired type of transmission and even generally for rpm control.

The means 25 include a PD-controller or PID-controller 10 to which the control deviation dn is supplied as an input quantity. The PD-controller or PID-controller 10 (referred to in the following as "controller") generates a preliminary desired quantity MDES' which, in this example, is a preliminary desired value for the engine output torque. Based on the preliminary actuating quantity MDES', the output quantity NMOTACT of the drive unit 1 tracks the input quantity NMOTDES in the sense of minimizing the control deviation dn. The preliminary actuating quantity MDES' is supplied to a limiter 15 of the means 25 which checks whether the preliminary actuating quantity MDES' lies within a pregiven actuating range or region Δ. If this is the case, then the preliminary actuating quantity MDES' is outputted to the drive unit 1 as controller output MDES; otherwise, the preliminary actuating quantity MDES' is limited in such a manner that it lies in the pregiven actuating range Δ. In this case, the controller output MDES, which is outputted by the means 25, is the preliminary actuating quantity limited correspondingly by the limiter 15.

The actuating range Δ is defined by a lower limit value MU and an upper limit value MO so that the following applies:

$$\Delta = MO - MU.$$

The arrangement 20 further includes limit value input means 45 which is driven by the transmission control 35 at least in the operating state of the shift operation described here. If there is a downshift with the shift operation, then the transmission control controls the limit value input means 45 in such a manner that it outputs a preliminary upper limit value MO'. If there is an upshift with the shift operation, then the transmission control 35 controls the limit value input means 35 in such a manner that it outputs a preliminary lower limit value MU'. In this embodiment, the preliminary upper limit value MO' defines a maximum engine output torque which can be generated. In this embodiment, the preliminary lower limit value MU' defines a minimum possible engine output torque. The output of the limit value input means 45 is conducted to a second coupling point 55 and a third coupling point 60. Furthermore, actuating region input means 50 are provided which set an actuating region Δ' which is to be adjusted and which are likewise driven by the transmission control 35 in the embodiment described here. The actuating region Δ', which is to be adjusted, is outputted by the actuating region input means 50 to a proportional-time member 5. The output of the proportional-time member 5 is likewise conducted to the second coupling point 55 and to the third coupling point 60. In the second coupling point 55, the output of the limit value input means 45 is added to the output of the proportional-time member 5. In the third coupling point 60, the output of the proportional-time member 5 is subtracted from the output of the limit value input means 55. The proportional-time member 5 has the function to realize a continuous time-dependent control of the actuating region Δ' which is to be adjusted. For this purpose, the proportional-time member 5 is configured, for example, in a first order and therefore as PT1 member or in a second order and therefore as PT2 member. Alternatively, and in lieu of the proportional-time member 5, a time-controlled ramp function can be used which makes possible a continuous time-dependent control of the actuating region Δ' which is to be adjusted. The output of the second coupling point 55 is conducted to a minimum value selection unit 75. A further input of the minimum value selection unit 75 is connected to a memory 65 for the preliminary upper limit value MO'. The minimum value selection unit 75 selects the minimum value from the two input quantities and outputs the same to the limiter 15 as a pregiven upper limit value MO. The output of the third coupling point 60 is conducted to a maximum value selection unit 80. A further input of the maximum value selection unit 80 is connected to a memory 70 for the preliminary lower limit value MU'. The maximum value selection unit 80 outputs the maximum value of its two input quantities to the limiter 15 as a pregiven lower limit value MU.

The operation of the block circuit diagram of FIG. 1 is described with respect to the time diagrams set forth in FIGS. 2*a* to 2*g*.

Figure 2A:
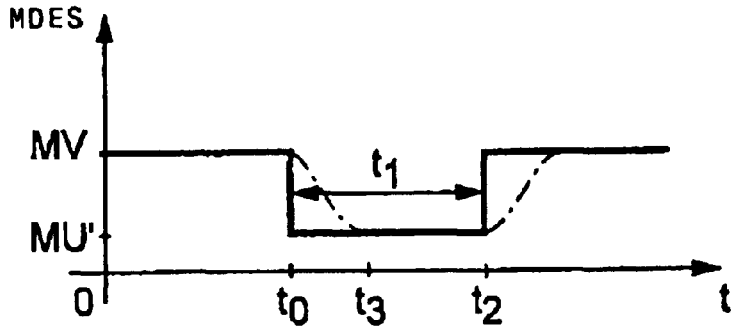
FIG. 2*a* is a graph showing the engine output torque as a function of time for a shift operation wherein there is an upshift.

In FIG. 2*a*, the desired value MDES of the engine output torque is plotted as a function of time (t) for an upshift during a shift operation of the transmission. At a first time point $t_0$, a second phase of the shift operation is reached after the opening of the clutch. With this phase, an upshift takes place with the clutch open. This means that the transmission control 35 inputs a lower rpm value for the engine rpm than previously.

Figure 2B:
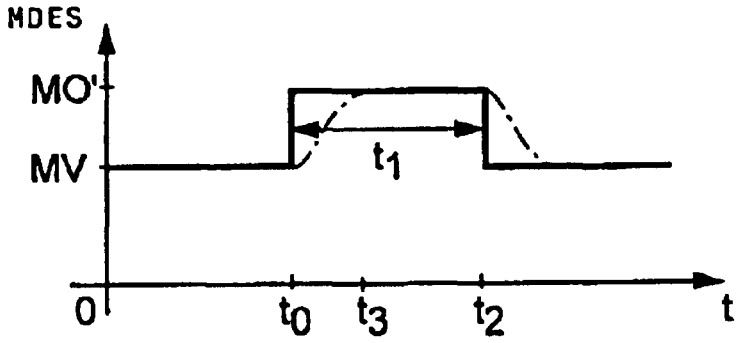
FIG. 2*b* shows the engine output torque plotted as a function of time for a shift operation wherein the shift operation is a downshift.
Figure 2C:
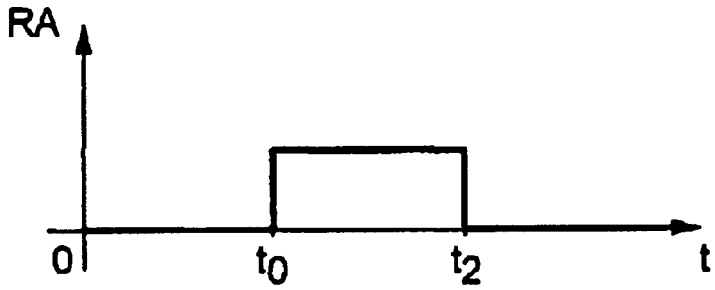
FIG. 2*c* is a graph of a control request plotted as a function of time for a shift operation.
Figure 2D:
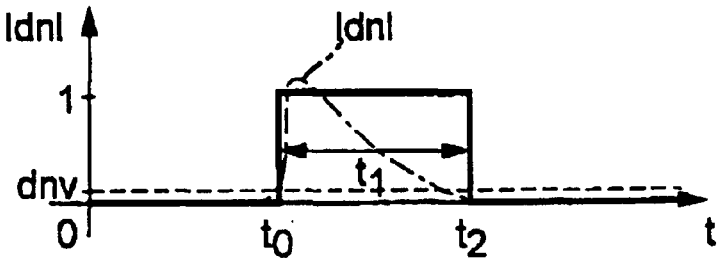
FIG. 2*d* shows a graph of the digitalized course of the rpm deviation as a function of time during a shift operation.

FIG. 2*d* is a plot of the magnitude |dn| of the control deviation of the output quantity NMOTACT plotted against time (t). Because of the above, the magnitude |dn| of the control deviation increases above a pregiven control deviation dnv at the first time point $t_0$ and is set to "one" in the digitalized illustration of FIG. 2*d*. The actual course of the magnitude |dn| of the control deviation is shown in FIG. 2*d* by the broken line in the same way as the pregiven control deviation dnv is shown. The actual magnitude |dn| of the control deviation first increases steeply at the first time point $t_0$ because, at the first time point $t_0$, the transmission control 35 requests the input value NMOTDES but the output quantity NMOTACT still lies at the previous value. With the means 25, a time-optimal control strategy for controlling out the control deviation dn is realized so that, when the magnitude |dn| of the control deviation according to FIG. 2*d* drops below the pregiven control deviation dnv only at a second time point $t_2$, the digitalized signal for the magnitude |dn| shown in FIG. 2*d* also returns from "one" to zero. The control deviation pulse formed thereby has the duration $t_1 = t_2 - t_0$.

In FIG. 2*c*, a control request signal RA is plotted as a function of time (t). With the magnitude |dn| of the control deviation exceeding the pregiven control deviation dnv at the first time point $t_0$, a control request signal is formed according to FIG. 2*c* which is outputted by the transmission control 35 to the limit value input means 45 and the actuating region input means 50 and the limit value input means 45 and the actuating region input means 50 are thereby initialized at the first time point $t_0$. The limit value input means 45 is thereby caused to output the preliminary lower limit value MU'.

Figure 2E:
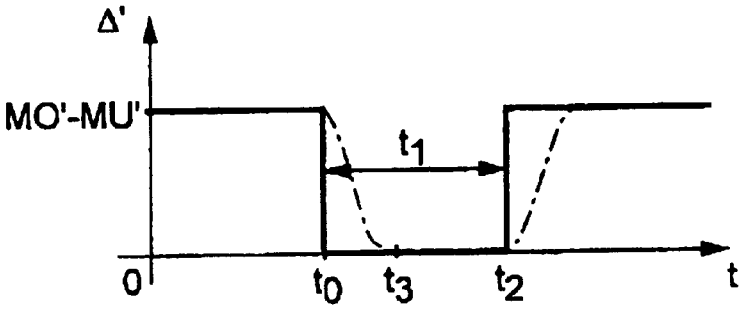
FIG. 2*e* shows the trace of an actuating region for an actuating quantity plotted as a function of time during a shift operation.

The course of the actuating region Δ' as a function of time (t) is shown in FIG. 2*e*. Here, the actuating region Δ', which is to be adjusted, is usually the difference of the preliminary upper limit value MO' and the preliminary lower limit value MU', that is, Δ'=MO'−MU'. Because of initialization by means of the control request signal at the first time point $t_0$, the actuating region input means 50 is, however, caused by the transmission control 35 to set the actuating region Δ' to zero. The forming descending flank of the signal for the actuating region Δ' is time delayed by the proportional-time member 5 as shown by the broken line in FIG. 2*e*. In this way, the jump-like course of the actuating region Δ' at the first time point $t_0$ is converted into a continuous strong nonchanging descending course.

Figure 2F:
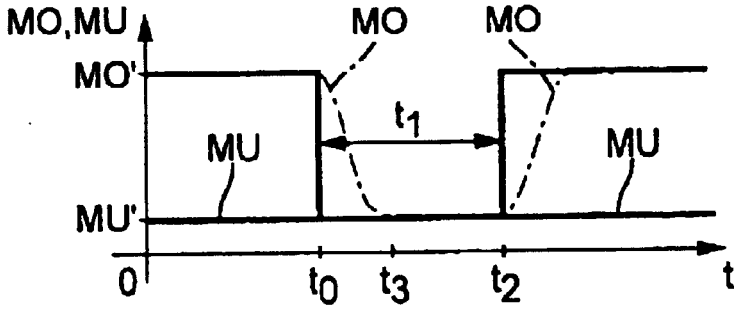
FIG. 2*f* shows a plot of the limits of the actuating region during a shift operation plotted as a function of time wherein the shift operation is an upshift; and, FIG. 2*g* is a plot of the limits of the actuating region plotted as a function of time during a shift operation wherein a downshift occurs.
Figure 2G:
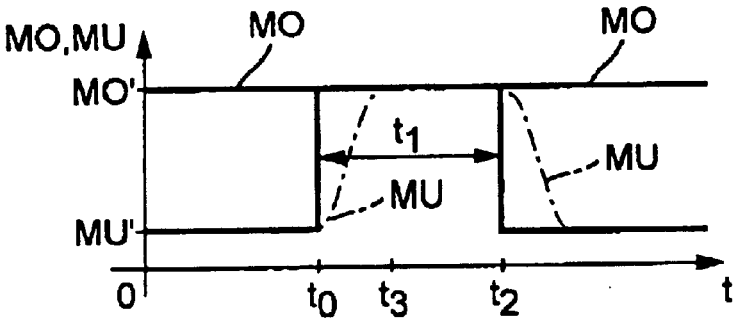

In FIG. 2*f*, the course of the pregiven upper limit value MO and of the pregiven lower limit value MU is shown as a function of time (t). Here, the pregiven lower limit value corresponds to the preliminary lower limit value MU' during the entire shift operation. In contrast, the pregiven upper limit value MO corresponds to the preliminary upper limit value MO' up to the first time point $t_0$ and then descends at the first time point $t_0$ continuously and unchangingly descending in accordance with the broken line illustration in FIG. 2*f* to the preliminary lower limit value MU' because of the proportional-time member 5. This limit value MU' is reached at a third time point $t_3$. In this way, the pregiven upper limit value MO corresponds to the pregiven lower limit value MU starting at the third time point $t_3$ so that, at the output of the limiter 15, the desired value MDES for the engine output torque assumes the value of the preliminary lower limit value MU' starting at the third time point $t_3$. In this way, starting at the third time point $t_3$, the minimum possible engine output torque is realized by the engine control of the drive unit 1 and the actual value NMOTACT of the engine rpm is reduced as fast as possible. At a second time point $t_2$ following the third time point $t_3$, the magnitude |dn| of the control deviation then drops back below the pregiven control deviation dnv. The magnitude |dn| of the control deviation can, in this way, be guided as fast as possible to below the pregiven control deviation dnv. In this way, a time-optimal control strategy for controlling out the rpm deviation can be realized.

As shown in FIG. 1, the output of the first coupling point 30 is also fed back to the transmission control 35 in order to impart the magnitude |dn| of the control deviation to the transmission control 35. Starting from the digitalized signal for the magnitude |dn| of the control deviation shown in FIG. 2*d*, the control request signal RA can be formed which is set with the setting of the digitalized magnitude |dn| of the control deviation and is set back with the resetting of the magnitude |dn| of the control deviation. Alternatively, the magnitude |dn| of the control deviation can be supplied to the engine control, proceeding from the first coupling point 30. The control request signal RA is then correspondingly formed in the engine control. In this way, according to FIG. 2*c*, the control request signal RA is set back at the second time point $t_2$. In the example described here, this means that, at the second time point $t_2$, the actuating region input means 50 is driven by the transmission control 35 in such a manner that the actuating region input means 50 again abruptly increases the actuating region Δ' to the output value MO'−MU'. Because of the proportional-time member 5, this abrupt increase is realized by a continuous strictly non-changing ascending increase as shown by the broken line in FIG. 2*e*. This, in turn, leads to a corresponding continuous non-changing ascending increase of the pregiven upper limit value MO, starting at the second time point $t_2$, to the preliminary upper limit value MO' as shown in FIG. 2*f* by the broken line. The pregiven lower limit value MU, however, remains, as before, at the preliminary lower limit value MU' so that the actuating region Δ=MO−MU is again expanded to the output value MO'−MU' starting at the second pregiven time point $t_2$. The control of the output quantity NMOTACT is then again completely assumed by the controller 10 within the actuating region Δ.

In this way, the desired value MDES of the engine output torque again climbs from the preliminary lower limit value MU' to a loss torque MV starting from the time point $t_2$. This loss torque is necessary in order to maintain the new output quantity NMOTACT and as it was set, for example, also up to the first time point $t_0$. As a rule, the loss torque MV is, however, also changed with changed engine rpm.

According to FIG. 2*b*, the desired value MDES for the engine output torque is shown as a function of time (t) for a shift operation wherein there is a downshift. In this case, starting from the first time point $t_0$, the transmission control 35 outputs a desired value NMOTDES for the engine rpm which is increased relative to the previous desired value. A course of the magnitude |dn| of the control deviation and a control request signal RA again result qualitatively as shown in FIGS. 2*d* and 2*c*, respectively. For downshifting, the transmission control 35 causes the limit value input means 45 to output the preliminary upper limit value MO'. Otherwise, as also when upshifting in accordance with FIG. 2*e*, the actuating region input means 50 causes the actuating region Δ' to be set to zero again starting from the first time point $t_0$ in the manner described. This time, the following course as a function of time (t) results for the pregiven upper limit MO and the pregiven lower limit MU in accordance with FIG. 2*d*. The pregiven upper limit value MO remains continuously at the preliminary upper limit value MO'; whereas, the pregiven lower limit value MU corresponds to the preliminary lower limit value MU' up to the first time point $t_0$ and, from the first time point $t_0$ onward, the pregiven lower limit value MU increases continuously and ascends strictly nonchangingly up to the preliminary upper limit value MO' in accordance with the broken line of FIG. 2*g*. The course of the actuating region Δ', which is to be adjusted, is then identical as in upshifting in accordance with FIG. 2*e*. This means that, starting from the third time point $t_3$ in accordance with FIG. 2*g*, the pregiven upper limit value MO corresponds to the pregiven lower limit value MU and is equal to the preliminary upper limit value MO'. In this way, from the third time point $t_3$ on, the pregiven upper limit value MO and the pregiven lower limit value MU are identical and the limiter 15 outputs the preliminary upper limit value MO' as the desired value MDES for the engine output torque as shown in FIG. 2*b*. The preliminary upper limit value MO' corresponds to the maximum engine output torque which can be generated. For this reason, the output quantity NMOTACT is increased as rapidly as possible and tracks the input value NMOTDES as rapidly as possible. In this way, a time-optimal control strategy for controlling out the rpm deviation or the control deviation dn is realized also for downshifting. The magnitude |dn| of the control deviation therefore returns as rapidly as possible below the pregiven control deviation dnv at the second time point $t_2$ so that the control request signal RA is set back at the second time point $t_2$ and the actuating region Δ' can be set back again from the second time point $t_2$ on to the output value MO'−MU'. Because of the proportional-time member 5, this jump is converted into a continuously strictly non-changing ascending function as shown in FIG. 2*e* by the broken line. According to FIG. 2*g*, this leads to the situation that, starting from the second time point $t_2$, the pregiven upper limit value MO still corresponds to the preliminary upper limit value MO'; whereas, from the second time point $t_2$, the pregiven lower limit value MU continuously and non-changingly descendingly returns from the preliminary upper limit value MO' to the preliminary lower limit value MU'. As soon as the pregiven lower limit value MU again reaches the preliminary lower limit value MU', the actuating region Δ is again expanded to its original value MO'−MU' and the limiter 15 limits the preliminary desired value MDES' of the controller 10 within this actuating region Δ.

At the second time point $t_2$, the input value NMOTDES, which is pregiven by the transmission control 35, is reached by the output quantity NMOTACT with a control deviation dnv so that the clutch can again be closed and the shift operation can be ended.

In view of the above, and starting from the second time point $t_2$ the output signal MDES of the controller 10 as a preliminary desired value of the engine output torque is influenced ever less by the limiter 15 because of the actuating region Δ which becomes ever greater. As shown in FIG. 2*b*, the controller 10 can then control the preliminary desired value MDES' to the loss torque MV from the second time point $t_2$ in order to maintain the output quantity NMOTACT. Within the actuating region Δ, the preliminary desired value MDES' also corresponds to the desired value or the desired quantity MDES. The course of the actuating quantity MDES is shown by a broken line in FIG. 2*b*. The broken-line illustrations in the individual diagrams of FIGS. 2*a* to 2*g* correspond, in each case, to the actual or real course of the pregiven limit values MO, MU of the actuating region Δ', which is to be adjusted, and the actuating quantity MDES as well as the magnitude |dn| of the control deviation.

With the method of the invention, the time-dependent course of the shift operation is improved in that the engine rpm, which is required for the continuation of the shift operation, can be set more rapidly. As described, this is achieved by utilizing a time-optimal control strategy and its prioritization relative to the controller 10. With the described time-optimal control strategy, the advantage of the more rapid controlling out of the control deviations of the engine rpm while maintaining the actuating region Δ is made possible relative to the controller 10. With the method of the invention, the shift operation is advantageously shortened, especially, the time span of the force interruption during the adjustment of the new engine rpm or the realization of the input value NMOTDES is shortened. The disadvantageous interruption of the power flow between the engine and the drive train during the shift operation is thereby shortened.

A PD control strategy or a PID control strategy can still be used by the controller 10 to control out small control deviations, which are less than or equal to the pregiven control deviations dnv, and continuous engine rpm curves. The transition from the PD control strategy or PID control strategy to the time-optimal control strategy is realized, as described, by reducing the width of the actuating region Δ. The transition from the time-optimal control strategy to the PD control strategy or PID control strategy is realized, as described, by again increasing the width of the actuating region Δ.

A PID control strategy can be used in lieu of a PD control strategy for an expected control deviation, which remains, for example, because of an imprecise modeling of the loss torque MV or because of a removal of torque via the clutch.

The method of the invention is advantageous especially for internal combustion engines with an operating-state dependent preliminary upper limit value MO' and an operating-state dependent preliminary lower limit value MU', for example, in engines having gasoline direct injection. The available actuating region Δ can be directly considered in the formation of the actuating quantity MDES without it being necessary to have an operating-state dependent parameterization of, for example, the controller 10. The actuating quantity MDES can thereby be formed in dependence upon operating state under optimal utilization of the available actuating region Δ for a rapid or time-optimal control.

In lieu of measuring the output quantity NMOTACT via the measuring device 40, the output quantity NMOTACT (here, the actual value of the engine rpm) can also be modeled. The actual value NMOTACT of the engine rpm is available thereby without the delay, which is caused by the measurement, at the input of the first coupling point 30 for the determination of the control deviation dn. For the modeling of the actual value NMOTACT of the engine rpm, the integral dependency between the engine rpm and the engine output torque can be used and the actual value NMOTACT can be computed correspondingly from the measured or modeled engine output torque actual value MACT.

For the described time-optimal control strategy, the controller 10 is not necessarily required and can also be omitted. The controller 10 is provided here only for the control of control deviations less than or equal to the inputted control deviation dnv.

Different strategies are possible for the here described time-dependent up and down control of the pregiven upper limit value MO and of the pregiven lower limit value MU. As described, dynamic members such as proportional-time members of the first or second order (so-called PT1 or PT2 members) can be used. Alternatively, a time-dependent control of the pregiven upper limit value MO or of the pregiven lower limit value MU can take place via a ramp having a constant slope over time.

The proportional-time member or the ramp function used is generally a delay member which is to steady a jump in the actuating region Δ which is to be adjusted. Generally, with the subject matter of the invention, the actuating region Δ', which is to be adjusted, is brought to the second coupling point 55 and the third coupling point 60 via a delay member. The delay of the delay member (for example, via a drivable time constant) can be selected in dependence upon the magnitude |dn| of the control deviation. For example, the greater the magnitude |dn| of the control deviation is, the smaller the delay can be selected. In this way, even for large control deviations, a rapid tracking of the output quantity NMOTACT can be achieved. Furthermore, the instantaneous driving state (for example, via the driver command torque requested by the driver via the position of the accelerator pedal), the instantaneous transmission ratio of the transmission or the type of driver can flow into the formation of the time constant for the delay member and, therefore, the time-dependent course for the adjustment of the actuating region Δ. A conclusion can be drawn as to a sporty driver from the gradients of previous accelerator pedal actuations wherein, when a pregiven threshold value of a gradient (averaged over several accelerator pedal actuations) is exceeded, a conclusion can be drawn as to a sporty driver and a conclusion is drawn as to an economic driver when there is a drop below this threshold value. For a sporty driver, a reduced delay of the delay member and therefore a more rapid tracking of the output quantity NMOTACT is provided than for an economic driver. Via the adjustable time constant of the delay member, an adaptation of the control velocity to different conditions and/or operating situations of the vehicle can be realized.

The drive of the time constant of the delay member and its variable adjustment is indicated in FIG. 1 based on the proportional-time member 5 via the time constant $\tau$ supplied to the proportional-time member 5.

It is understood that the foregoing description is that of the preferred embodiments of the invention and that various changes and modifications may be made thereto without departing from the spirit and scope of the invention as defined in the appended claims.

What is claimed is:

1. A method for controlling an output quantity (NMOTACT) of a drive unit of a motor vehicle, the method comprising the steps of:

adjusting said output quantity (NMOTACT) utilizing a controller output (MDES) and causing said output quantity (NMOTACT) to track an input value (NMOTDES); and, bringing said controller output (MDES) to a pregiven limit value (MO, MU) in at least one pregiven operating state of said vehicle when a pregiven control deviation (dnv) of said output quantity (NMOTACT) is exceeded.

2. The method of claim 1, wherein an engine rpm of said drive unit is used as said output quantity (NMOTACT).

3. The method of claim 2, wherein an engine output torque of said drive unit is used as said controller output (MDES).

4. The method of claim 1, comprising the further step of bringing said controller output (MDES) to a pregiven limit value (MO, MU) utilizing a delay member.

5. The method of claim 4, wherein said delay member is a proportional time member.

6. The method of claim 4, comprising the further step of variably adjusting a time constant of said delay member.

7. The method of claim 6, comprising the further step of adjusting said time constant in dependence upon at least one of a control deviation (dn), a driving state, a transmission ratio and a type of driver.

8. The method of claim 1, wherein said pregiven operating state is a shift operation of an automatic transmission or an automated manually-shifted transmission.

9. The method of claim 1, comprising the further steps of:

controlling said output quantity (NMOTACT) with a PD controller or a PID controller which generates said controller output (MDES) therefor;

limiting said controller output (MDES) in a limiter to a pregiven actuating region ($\Delta$); and, bringing the width of said pregiven actuating region ($\Delta$) to zero in said at least one operating state.

10. The method of claim 9, comprising the further step of again increasing said width of said actuating region ($\Delta$) as soon as the pregiven control deviation (dnv) is reached or there is a drop therebelow.

11. An arrangement for controlling an output quantity (NMOTACT) of a drive unit of a motor vehicle, the arrangement comprising:

means for adjusting said output quantity (NMOTACT) utilizing a controller output (MDES) and causing said output quantity (NMOTACT) to track an input value (NMOTDES); and, means for bringing said controller output (MDES) to a pregiven limit value (MO, MU) in at least one pregiven operating state of said vehicle when a pregiven control deviation (dnv) of said output quantity (NMOTACT) is exceeded.

* * * * *